US011904432B2

(12) United States Patent
Fujimura et al.

(10) Patent No.: US 11,904,432 B2
(45) Date of Patent: Feb. 20, 2024

(54) GRINDING APPARATUS

(71) Applicant: DISCO CORPORATION, Tokyo (JP)

(72) Inventors: Satoru Fujimura, Tokyo (JP); Keita Nakamura, Tokyo (JP); Shinji Yamashita, Tokyo (JP)

(73) Assignee: DISCO CORPORATION, Tokyo (JP)

( * ) Notice: Subject to any disclaimer, the term of this patent is extended or adjusted under 35 U.S.C. 154(b) by 0 days.

(21) Appl. No.: 17/806,814

(22) Filed: Jun. 14, 2022

(65) Prior Publication Data

US 2022/0402093 A1 Dec. 22, 2022

(30) Foreign Application Priority Data

Jun. 17, 2021 (JP) ..... 2021-101050

(51) Int. Cl.
*B24B 49/04* (2006.01)
*B24B 7/22* (2006.01)
*B24B 7/04* (2006.01)

(52) U.S. Cl.
CPC ..... *B24B 49/04* (2013.01); *B24B 7/04* (2013.01); *B24B 7/228* (2013.01)

(58) Field of Classification Search
CPC ..... B24B 49/04; B24B 49/12; B24B 49/10; B24B 49/105; B24B 49/006; B24B 49/02; B24B 7/04; B24B 7/228; B24B 37/005; B24B 37/04; B24B 37/042; B24B 37/07; B24B 37/10; B24B 37/105
USPC ..... 451/11
See application file for complete search history.

(56) References Cited

U.S. PATENT DOCUMENTS 6,406,357 B1 * 6/2002 Kazui ..... B28D 5/0094 451/287
2004/0048550 A1 * 3/2004 Halley ..... B24B 57/02 451/5
2011/0130073 A1 * 6/2011 Furukawa ..... H01L 21/304 451/6
2014/0183163 A1 * 7/2014 Sugiya ..... B24B 1/00 216/52

FOREIGN PATENT DOCUMENTS

GB 2268895 A * 1/1994 ..... B24B 1/00
JP 2016184604 A 10/2016
JP 2018034283 A 3/2018
JP 2020026010 A 2/2020
JP 6687455 B2 * 4/2020

* cited by examiner

*Primary Examiner* — Joel D Crandall
*Assistant Examiner* — Michael A Gump
(74) *Attorney, Agent, or Firm* — Greer Burns & Crain Ltd.

(57) ABSTRACT

A rotation controlling section of a control unit calculates a maximum thicknesswise difference in a wafer by using a noncontact thickness measuring instrument, and if the maximum thicknesswise difference exceeds a tolerance, relatively changes a rotational speed of a chuck table relative to a rotational speed of a spindle. This can shift a rotational speed ratio, which is a ratio between the rotational speed of the spindle and the rotational speed of the chuck table, from an integer. Therefore, the maximum thicknesswise difference can be made small through spark-out processing. As a result, cyclic variations in thickness value of the wafer are reduced, enabling planarization of a ground surface of the wafer.

4 Claims, 4 Drawing Sheets

GRINDING APPARATUS

BACKGROUND OF THE INVENTION

Field of the Invention

The present invention relates to a grinding apparatus.

Description of the Related Art

A grinding apparatus that grinds a wafer held by a chuck table with use of grindstones includes, for example, a noncontact thickness measuring instrument for measuring a thickness of the wafer, in a noncontact manner. With this configuration, grinding is carried out until the thickness of the wafer, which is measured by the noncontact thickness measuring instrument during grinding, becomes a desired thickness set in advance (see Japanese Patent Laid-open Nos. 2016-184604, 2018-034283, and 2020-026010).

SUMMARY OF THE INVENTION

The wafer having been ground to the desired thickness sometimes has slight irregularities formed in an arcuate shape along a locus of the grindstones. Such slight irregularities can cause a negative influence on devices formed on the wafer.

Accordingly, it is an object of the present invention to provide a grinding apparatus that can suppress formation of slight arcuate irregularities on the ground wafer.

In accordance with an aspect of the present invention, there is provided a grinding apparatus including a chuck table, a table rotating mechanism, a grinding unit, a spindle rotating mechanism, a noncontact thickness measuring instrument, and a rotation controlling section. The chuck table has a holding surface to hold a wafer thereon. The table rotating mechanism rotates the chuck table about its axis extending through a center of the holding surface. The grinding unit is mounted to a distal end of a spindle and grinds the wafer by using a plurality of grindstones arranged in an annular fashion, the grindstones being rotated in such a manner as to pass above the center of the holding surface. The spindle rotating mechanism rotates the spindle. The noncontact thickness measuring instrument measures a thickness of the wafer held on the holding surface, in a noncontact manner. The rotation controlling section causes the chuck table to rotate and carries out rotation control of measuring the thickness of the wafer being ground, by using the noncontact thickness measuring instrument, and changing a rotational speed of the chuck table in a relative manner with respect to a rotational speed of the spindle if a difference between a minimum value and a maximum value of cyclic variations in thickness value of the wafer which variations are generated along a direction of rotation of the wafer exceeds a tolerance based on a desired thickness set in advance.

Preferably, the rotation controlling section carries out the rotation control in a period during which movement of the grindstones in a direction approaching the holding surface is stopped.

According to the present invention, the difference (maximum thicknesswise difference) between the minimum value and the maximum value of the cyclic variations in thickness value of the wafer is calculated by using the noncontact thickness measuring instrument, and if the maximum thicknesswise difference exceeds the tolerance, the rotation controlling section relatively changes the rotational speed of the chuck table relative to the rotational speed of the spindle. By changing the rotational speed of the chuck table, even when a rotational speed ratio, which is a ratio between the rotational speed of the spindle and the rotational speed of the chuck table, is an integer, the rotational speed ratio can be shifted from an integer. Therefore, the maximum thicknesswise difference formed on a ground surface of the wafer can be made small through the grinding processing. As a result, the cyclic variations in thickness value of the wafer are reduced, enabling planarization of the ground surface of the wafer. Accordingly, it is possible to suppress formation of slight arcuate irregularities on the ground wafer.

The above and other objects, features and advantages of the present invention and the manner of realizing them will become more apparent, and the invention itself will best be understood from a study of the following description and appended claims with reference to the attached drawings showing a preferred embodiment of the invention.

DETAILED DESCRIPTION OF THE PREFERRED EMBODIMENT

Figure 1:
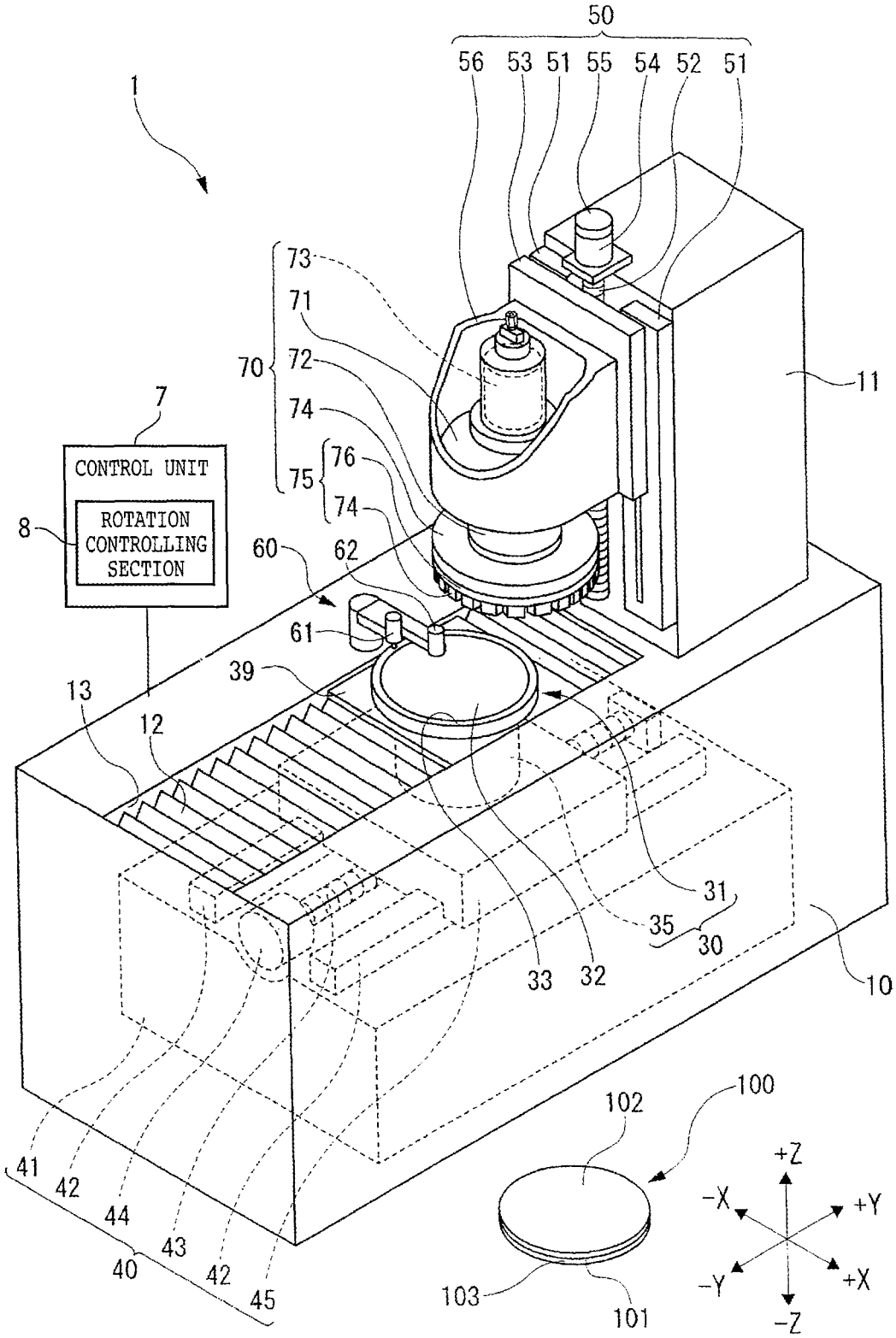
FIG. 1 is a perspective view illustrating a configuration of a grinding apparatus.

As illustrated in FIG. 1, a grinding apparatus 1 according to the present embodiment is an apparatus for grinding a wafer 100 as a workpiece and includes a base 10 in a rectangular parallelopiped shape and a column 11 extending upward from the base 10.

The wafer 100 is a circular semiconductor wafer, for example. One surface of the wafer 100 facing downward in FIG. 1 serves as a device surface 101 on which a plurality of devices are to be held, and the devices are protected by a protective tape 103 stuck to the one surface. Another surface of the wafer 100 serves as a ground surface 102 to be subject to grinding processing.

The base 10 has an opening 13 defined on an upper surface side thereof. A wafer holding mechanism 30 is disposed inside the opening 13. The wafer holding mechanism 30 includes a chuck table 31 having a holding surface 32 to hold the wafer 100 thereon and a table rotating mechanism 35 that supports and rotates the chuck table 31.

The chuck table 31 has the holding surface 32 for holding the wafer 100 thereon and a frame body 33 supporting the holding surface 32. The holding surface 32 is formed of a porous material and is connected to a suction source (not illustrated) to hold the wafer 100 under suction. In other words, the chuck table 31 holds the wafer 100 on the holding surface 32. The holding surface 32 is formed to be flush with an upper surface of the frame body 33.

The table rotating mechanism 35 supports the chuck table 31 from below. The table rotating mechanism 35 is configured to rotate the chuck table 31 about its axis extending through a center of the holding surface 32.

On a periphery of the chuck table 31, a cover plate 39 that is movable in Y-axis directions together with the chuck table 31 is provided. The cover plate 39 is connected to a bellows-like cover 12 that expands and contracts in the Y-axis directions. Under the wafer holding mechanism 30, a Y-axis direction moving mechanism 40 is disposed.

The Y-axis direction moving mechanism 40 moves the chuck table 31 and a grinding unit 70 relative to each other in the Y-axis directions which extend in parallel with the holding surface 32. The Y-axis direction moving mechanism 40 in the present embodiment is configured to move the chuck table 31 relative to the grinding unit 70 in the Y-axis directions.

The Y-axis direction moving mechanism 40 includes a pair of Y-axis guide rails 42 extending in parallel with the Y-axis directions, a Y-axis movable table 45 movable slidably on the Y-axis guide rails 42, a Y-axis ball screw 43 extending in parallel with the Y-axis guide rails 42, a Y-axis motor 44 connected to the Y-axis ball screw 43, and a holding stand 41 holding the above components.

The Y-axis movable table 45 is slidably mounted on the Y-axis guide rails 42. The Y-axis movable table 45 has a nut section (not illustrated) fixed to a lower surface thereof. The Y-axis ball screw 43 is screwed into the nut section. The Y-axis motor 44 is connected to one end portion of the Y-axis ball screw 43 as illustrated in FIG. 1.

In the Y-axis direction moving mechanism 40, when the Y-axis motor 44 rotates the Y-axis ball screw 43, the Y-axis movable table 45 is moved along the Y-axis guide rails 42 in the Y-axis directions. The table rotating mechanism 35 of the wafer holding mechanism 30 is mounted on the Y-axis movable table 45. Therefore, when the Y-axis movable table 45 is moved in the Y-axis directions, the wafer holding mechanism 30 including the table rotating mechanism 35 and the chuck table 31 is moved in the Y-axis directions accordingly.

In the present embodiment, the wafer holding mechanism 30 is moved in the Y-axis directions by the Y-axis direction moving mechanism 40, between a workpiece placing position located on the −Y direction side where the wafer 100 is placed and held on the holding surface 32 and a grinding position located on the +Y direction side where the wafer 100 is ground.

As illustrated in FIG. 1, the column 11 is mounted upright on a rear side (+Y direction side) on the base 10. The grinding unit 70 that grinds the wafer 100 and a grinding feed mechanism 50 are mounted to a front surface of the column 11.

The grinding feed mechanism 50 moves the chuck table 31 and a grindstone part 77 of the grinding unit 70 relative to each other in Z-axis directions (grinding feed directions) extending perpendicularly to the holding surface 32. The grinding feed mechanism 50 in the present embodiment is configured to move the grindstone part 77 in the Z-axis directions relative to the chuck table 31.

The grinding feed mechanism 50 includes a pair of Z-axis guide rails 51 extending in parallel with the Z-axis directions, a Z-axis movable table 53 movable slidably on the Z-axis guide rails 51, a Z-axis ball screw 52 extending in parallel with the Z-axis guide rails 51, a Z-axis motor 54, an encoder 55 for detecting a rotation angle of the Z-axis ball screw 52, and a support casing 56 mounted to the Z-axis movable table 53. The support casing 56 supports the grinding unit 70.

The Z-axis movable table 53 is slidably mounted on the Z-axis guide rails 51. The Z-axis movable table 53 has a nut section (not illustrated) fixed thereto. The Z-axis ball screw 52 is screwed into the nut section. The Z-axis motor 54 is connected to one end portion of the Z-axis ball screw 52.

In the grinding feed mechanism 50, when the Z-axis motor 54 rotates the Z-axis ball screw 52, the Z-axis movable table 53 is moved along the Z-axis guide rails 51 in the Z-axis directions. The support casing 56 mounted to the Z-axis movable table 53 and the grinding unit 70 supported by the support casing 56 are accordingly moved in the Z-axis directions together with the Z-axis movable table 53.

The encoder 55 is rotated when the Z-axis motor 54 rotates the Z-axis ball screw 52, and can recognize the rotation angle of the Z-axis ball screw 52. A height position of the grindstone part 77 of the grinding unit 70 being moved in the Z-axis directions can be detected on the basis of a result of the recognition by the encoder 55.

The grinding unit 70 includes a spindle housing 71 fixed to the support casing 56, a spindle 72 rotatably held by the spindle housing 71, a spindle motor 73 that drives the spindle 72 to rotate, a wheel mount 74 attached to a lower end of the spindle 72, and a grinding wheel 75 supported on the wheel mount 74.

The spindle housing 71 is held by the support casing 56 in such a manner as to extend in the Z-axis directions. The spindle 72 extends in the Z-axis directions perpendicularly to the holding surface 32 of the chuck table 31 and is rotatably supported by the spindle housing 71.

The spindle motor 73 is connected to an upper end side of the spindle 72. The spindle motor 73 causes the spindle 72 to rotate about its axis extending in the Z-axis directions. The spindle motor 73 is an example of a spindle rotating mechanism that causes the spindle 72 to rotate.

The wheel mount 74 is formed in a disk shape and fixed to the lower end (distal end) of the spindle 72. The wheel mount 74 supports the grinding wheel 75.

The grinding wheel 75 is formed to have an outer diameter substantially the same as an outer diameter of the wheel mount 74. The grinding wheel 75 includes a ring-shaped wheel base (annular base) 76 formed of a metallic material. To the entire circumference of a lower surface of the wheel base 76, the annular grindstone part 77 having a plurality of segment grindstones arranged in an annular fashion is fixed.

The annular grindstone part 77 is disposed in such a position that a lower surface of the grindstone part 77 passes above the center of the holding surface 32 of the chuck table 31, and has such an inner diameter as to horizontally protrude from the holding surface 32. It is to be noted that the annular grindstone part 77 has the segment grindstones arranged in an annular fashion with a gap provided between adjacent segment grindstones.

The annular grindstone part 77 is rotated about its axis extending through a center thereof in the Z-axis directions by the spindle motor 73 via the spindle 72, the wheel mount 74, and the wheel base 76 in such a manner as to pass above the center of the holding surface 32 of the chuck table 31. The grindstone part 77 is thus brought into contact with a radius portion of the wafer 100 held on the holding surface 32 of the chuck table 31 located at the grinding position, to thereby grind the wafer 100.

It is to be noted that, in a radius portion of the holding surface 32, there is formed a grinding area which is parallel to the lower surface of the grindstone part 77. The grinding area is parallel to the grindstone part 77 when the wafer 100 is rotated about its axis extending through the center of the holding surface 32. It is to be noted that the annular grindstone part 77 may be a continuous grindstone part having a plurality of segment grindstones arranged in an annular fashion with no gap provided therebetween.

In this manner, the grinding unit 70 grinds the wafer 100 held on the holding surface 32 being rotated, by using the grindstone part 77 that is mounted to the distal end of the spindle 72 via the wheel mount 74 and the wheel base 76 and that is rotated in such a manner as to pass above the center of the holding surface 32.

Moreover, as illustrated in FIG. 1, a noncontact thickness measuring instrument 60 is disposed on the base 10 at a side of the opening 13. The noncontact thickness measuring instrument 60 can measure a thickness of the wafer 100 held on the holding surface 32, in a noncontact manner.

The noncontact thickness measuring instrument 60 may include one noncontact thickness measuring section, for example, a laser-type thickness measuring section. In this case, the thickness measuring section irradiates the wafer 100 with, for example, a laser beam of a wavelength having a transmitting property to the wafer 100, receives light reflected from a lower surface of the wafer 100 and light reflected from an upper surface of the wafer 100, and measures the thickness of the wafer 100 on the basis of a difference between optical paths of the reflected light. It is to be noted that the one noncontact thickness measuring section may be a wafer thickness meter using interference spectroscopy that measures the thickness of the wafer 100 by analyzing interference light between the light reflected from the lower surface of the wafer 100 and the light reflected from the upper surface of the wafer 100. Further, the one noncontact thickness measuring section may include a super luminescent diode (SLD) as a light source that emits measurement light.

It is to be noted that the noncontact thickness measuring instrument 60 may include a holding surface height measuring section 61 and a wafer height measuring section 62 as illustrated in FIG. 1. The holding surface height measuring section 61 and the wafer height measuring section 62 are each a noncontact height gauge and may each be a laser-type distance measuring instrument.

For example, the holding surface height measuring section 61 irradiates the upper surface of the frame body 33 of the chuck table 31 with a laser beam and measures a height of the upper surface of the frame body 33 (i.e., height of the holding surface 32) on the basis of the reflected light. Meanwhile, the wafer height measuring section 62 irradiates the upper surface (ground surface 102) of the wafer 100 with a laser beam and measures a height of the upper surface of the wafer 100 on the basis of the reflected light. The noncontact thickness measuring instrument 60 calculates the thickness of the wafer 100 on the basis of a difference between the measured height of the holding surface 32 and the measured height of the upper surface of the wafer 100.

It is to be noted that the holding surface height measuring section 61 and the wafer height measuring section 62 may be configured such that they measure the height of the holding surface 32 and the height of the upper surface of the wafer 100 by irradiating the upper surfaces of the frame body 33 and the wafer 100 with sound waves.

In addition, the grinding apparatus 1 includes a control unit 7 having a rotation controlling section 8. The control unit 7 includes a central processing unit (CPU) that carries out arithmetic processing according to a control program, a storage medium such as a memory, and the like. The control unit 7 controls the respective components described above of the grinding apparatus 1 to carry out grinding processing on the wafer 100.

The rotation controlling section 8 has a function of controlling, at the time of the grinding processing, the rotation of the chuck table 31 by the table rotating mechanism 35 and the rotation of the spindle 72 by the spindle motor 73.

Described below is the grinding processing in the grinding apparatus 1. In the grinding processing in the grinding apparatus 1, first, an operator causes the wafer 100 to be held on the holding surface 32 (see FIG. 1) of the chuck table 31 located at the workpiece placing position in such a manner that the ground surface 102 faces upward.

Next, the control unit 7 controls the Y-axis direction moving mechanism 40 to move the chuck table 31 in the Y-axis directions, so that the chuck table 31 is placed at the grinding position below the grinding unit 70. At the grinding position, the grindstone part 77 is aligned with the center of rotation of the wafer 100 held on the holding surface 32 of the chuck table 31.

The control unit 7 further controls the spindle motor 73 of the grinding unit 70 to rotate the grindstone part 77 together with the spindle 72. A rotational speed of the spindle 72 is set to 1650 rpm in the present embodiment. In addition, the rotation controlling section 8 controls the table rotating mechanism 35 to rotate the holding surface 32 of the chuck table 31 holding the wafer 100 thereon. A rotational speed of the chuck table 31 is set to 150 rpm in the present embodiment.

Subsequently, the control unit 7 causes the grinding feed mechanism 50 to bring the grinding unit 70, which is located at an original height position above the holding surface 32 at which position the lower surface (grinding surface) of the grindstone part 77 does not make contact with the wafer 100 held on the holding surface 32, closer to the chuck table 31.

Figure 2:
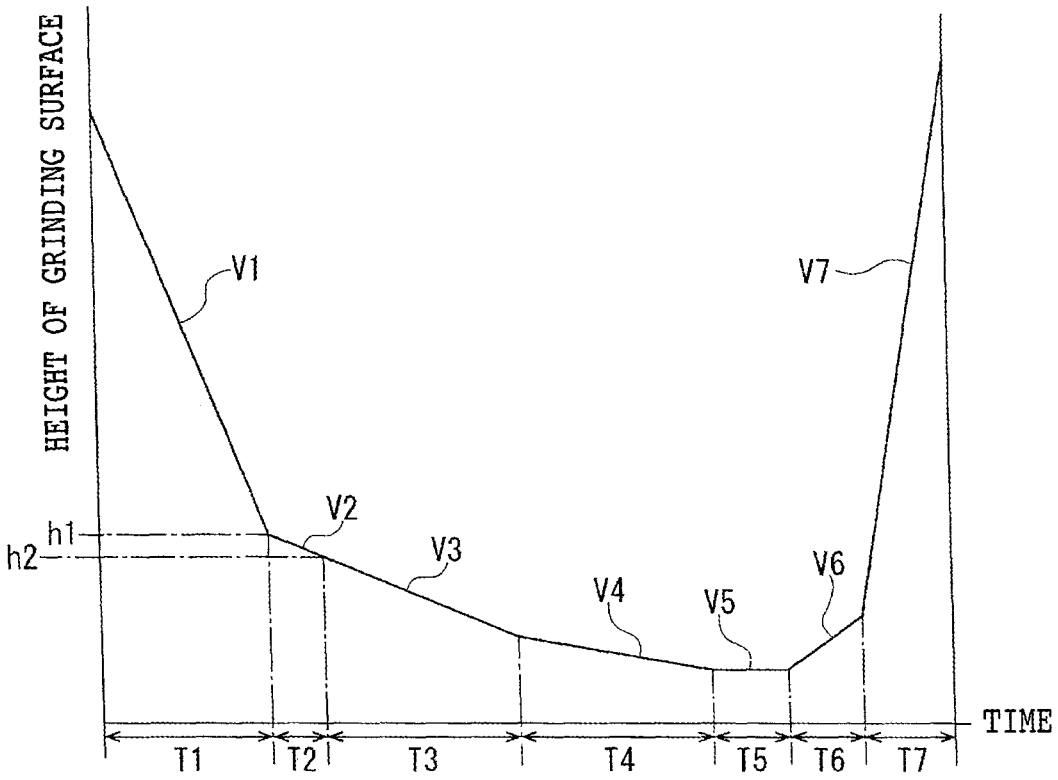
FIG. 2 is a graph illustrating a temporal change in height of a grindstone part.

FIG. 2 illustrates a temporal change in height of the grindstone part 77 (height of the grinding surface (lower surface) of the grindstone part 77). As illustrated in FIG. 2, the control unit 7 first lowers the grinding unit 70 to bring it closer to the chuck table 31 at a relatively high initial speed V1 until the height of the grindstone part 77 reaches a predetermined air-cut starting height h1 (time range T1).

The control unit 7 detects the height position of the grindstone part 77 in the Z-axis directions by using the encoder 55 as needed, for example. After the grinding surface of the grindstone part 77 reaches the predetermined air-cut starting height h1, the control unit 7 sets the lowering speed of the grinding unit 70 to an air-cut speed V2 lower than the initial speed V1, by using the grinding feed mechanism 50. The control unit 7 causes the grinding feed mechanism 50 to bring the grinding unit 70 closer to the chuck table 31 at the air-cut speed V2 (time range T2).

During the time range T2, the grindstone part 77 is not in contact with the wafer 100 yet, and air cut is being carried out. Thereafter, the control unit 7 causes the grinding feed mechanism 50 to bring the grindstone part 77 closer to the holding surface 32 of the chuck table 31, so that the grinding surface of the grindstone part 77 comes into contact with the ground surface 102 of the wafer 100 held on the holding surface 32.

When the grinding surface of the grindstone part 77 reaches a height h2 at which it comes into contact with the ground surface 102 of the wafer 100, the control unit 7 carries out grinding of the ground surface 102 of the wafer 100 by using the grindstone part 77 at a first grinding speed V3 (time range T3; first grinding processing). The first grinding speed V3 is a speed lower than the initial speed V1, for example, a speed substantially the same as the air-cut speed V2. Through the first grinding processing, the ground surface 102 of the wafer 100 is ground by approximately 30 μm, for example.

The control unit 7 measures the thickness of the wafer 100 being ground, as needed, by using the noncontact thickness measuring instrument 60. When a minimum thickness of the wafer 100 measured by the noncontact thickness measuring instrument 60 is almost a predetermined value (target value), the control unit 7 causes the grinding feed mechanism 50 to bring the grinding unit 70 closer to the chuck table 31 at a second grinding speed V4 lower than the first grinding speed V3 (time range T4). In other words, the control unit 7 further decreases the lowering speed of the grinding unit 70 from the first grinding speed V3 to the second grinding speed V4 and continues the grinding processing (second grinding processing). The second grinding processing reduces saw marks that have been formed on the wafer 100 in the first grinding processing. Through the second grinding processing, the ground surface 102 of the wafer 100 is ground by approximately 10 μm, for example.

When the minimum thickness of the wafer 100 measured by the noncontact thickness measuring instrument 60 reaches a predetermined value, the control unit 7 stops the lowering operation of the grinding unit 70 and carries out what is generally called spark-out processing (time range T5).

That is, the control unit 7 stops the lowering operation of bringing the grinding unit 70 closer to the holding surface 32 of the chuck table 31. Through such spark-out processing, grinding unevenness formed on the ground surface 102 of the wafer 100 is removed, and the rotation controlling section 8 carries out rotation control to be described later to rotate the chuck table 31 and reduce cyclic variations in thickness value of the wafer 100 measured by the noncontact thickness measuring instrument 60, so that the ground surface 102 of the wafer 100 is planarized.

After the spark-out processing is completed, the control unit 7 carries out escaping-cut processing (time range T6). In this regard, the control unit 7 causes the grinding feed mechanism 50 to slowly raise the grinding unit 70 at an escaping-cut processing speed V6 set in advance, to thereby carry out the escaping-cut processing on the wafer 100 with use of the grindstone part 77.

The escaping-cut processing is carried out, for example, until the grindstone part 77 is separated from the ground surface 102 of the wafer 100. After the escaping-cut processing is completed, the control unit 7 causes the grinding feed mechanism 50 to retract the grinding unit 70 to the original height position at a relatively high retracting speed V7 (time range T7).

Now, description is made regarding the rotation control carried out by the rotation controlling section 8 described above for reducing the cyclic variations in thickness value of the wafer 100 and planarizing the ground surface 102 of the wafer 100. First, a mechanism as to how cyclic variations in thickness value are generated in the wafer 100 is described.

Figure 3A:
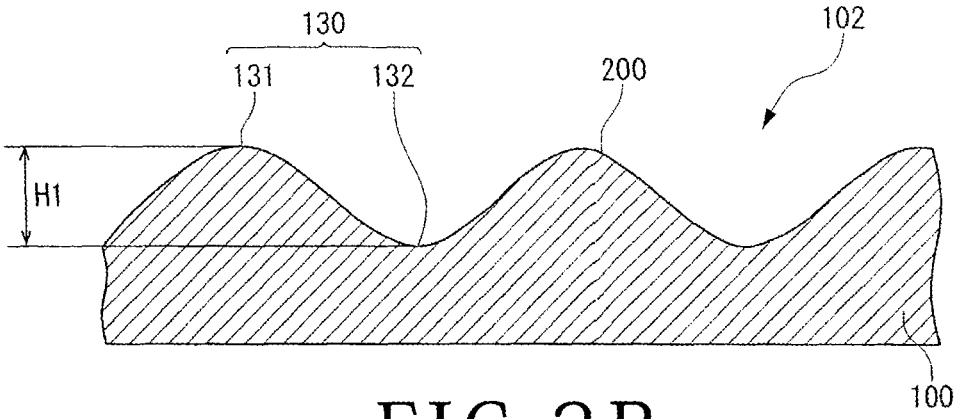
FIGS. 3A to 3C are sectional views illustrating saw marks formed on a ground surface of a wafer.

When the wafer 100 is ground with use of the grindstone part 77, cyclic variations in thickness value are sometimes generated along the direction of rotation of the wafer 100. More specifically, as illustrated in FIG. 3A, cyclic saw marks (unevenness in thickness or undulations) 130 as cyclic variations in thickness value are sometimes formed on the ground surface 102 of the wafer 100 along the direction of rotation of the wafer 100. The saw marks 130 correspond to a locus 200 of the grinding surface of the grindstone part 77 at the time of grinding and include protruding portions 131 and recessed portions 132 appearing in a predetermined cycle.

In other words, the saw marks 130 are formed along loci of the grinding surfaces of the respective segment grindstones constituting the annular grindstone part 77. It is to be noted that the saw marks 130 are traces along which outer circumferences of the segment grindstones have passed. Therefore, the saw marks 130 are liable to be formed in the case of using the annular grindstone part 77 having the segment grindstones arranged with a gap provided therebetween. Also in the case of using a continuous annular grindstone part 77 having the segment grindstones arranged with no gap provided therebetween, the saw marks 130 are formed because loads applied on the respective segment grindstones are different from one another and amounts of compression of the segment grindstones are different from one another.

A height H1 of the saw marks 130 (i.e., height difference between the protruding portion 131 and the recessed portion 132) is conspicuous when a rotational speed ratio RN is an integer. Here, the rotational speed ratio RN is represented as RN=N1/N2 where N1 denotes a rotational speed of the spindle 72 (rotational speed of the grindstone part 77) and N2 denotes a rotational speed of the chuck table 31 (rotational speed of the wafer 100).

Figure 4A:
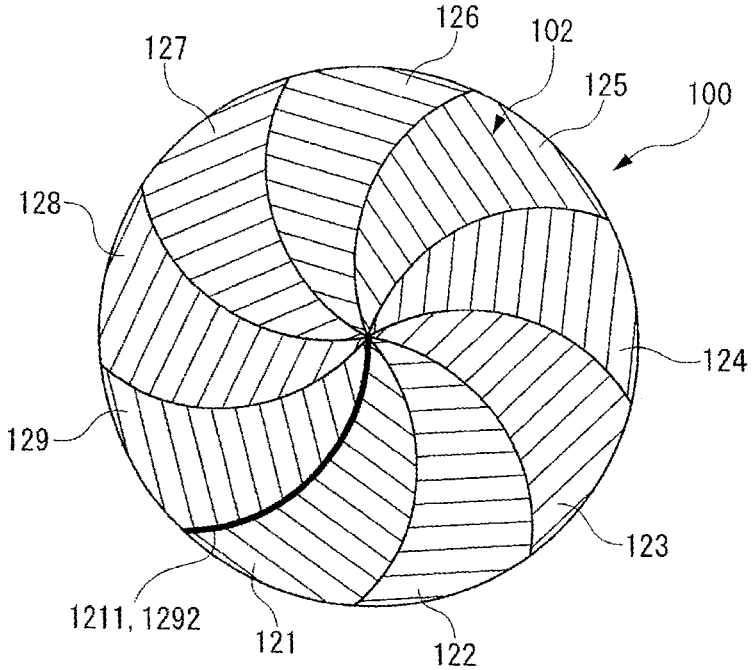
FIG. 4A is a plan view illustrating segment saw marks formed on the ground surface of the wafer when a rotational speed ratio is an integer.

When the rotational speed ratio RN is an integer (RN=9, for example), in a period during which the chuck table 31 makes one rotation, RN (9) segment saw marks 121 to 129 including saw marks of substantially the same size formed by the individual segment grindstones of the annular grindstone part 77 are arranged on the ground surface 102 of the wafer 100 with no gap provided therebetween, as illustrated in FIG. 4A.

It is to be noted that the segment saw marks 121 to 129 may be formed by only one segment grindstone. Alternatively, the segment saw marks 121 to 129 may be formed due to overlapping of loci of a plurality of segment grindstones. The segment saw marks 121 to 129 correspond to the saw marks 130 illustrated in FIG. 3A.

Here, the segment saw marks 121 to 129 are regions on the ground surface 102 of the wafer 100 which regions have made a geometric interference with the grinding surface of the grindstone part 77 in a period during which the grindstone part 77 makes one rotation. The segment saw marks 121 to 129 each have a shape surrounded by two substantially arc curves extending from the center of the wafer 100 toward an outer circumference of the wafer 100 and one section of the outer circumference of the wafer 100.

When the rotational speed ratio RN is an integer, as indicated by a bold line in FIG. 4A, a starting position 1211 of the first segment saw mark 121 coincides with an ending position 1292 of the last segment saw mark 129 in the first rotation of the chuck table 31.

The ending position 1292 of the last segment saw mark 129 here serves also as the starting position of the first segment saw mark 121 in the second rotation. Also in the second, third, and subsequent rotations of the chuck table 31, the starting position 1211 of the first segment saw mark 121 is thus located at substantially the same position as in the first rotation.

Therefore, when the rotational speed ratio RN is an integer, the arrangement of the segment saw marks 121 to 129 on the ground surface 102 of the wafer 100 rarely changes even after the chuck table 31 is rotated a plurality of times during the spark-out processing, and the grinding surface of the grindstone part 77 traces substantially the same locus on the wafer 100.

For this reason, the height difference of the grinding surface of the grindstone part 77 coincides with irregularities already formed on the ground surface 102, at all times, and it is difficult for the grinding surface of the grindstone part 77 to grind off the protruding portions 131 illustrated in FIG. 3A. As a result, even if the chuck table 31 is rotated many times during the spark-out processing, it is difficult to sufficiently reduce the saw marks 130, leaving the saw marks 130 having relatively large irregularities.

Figure 4B:
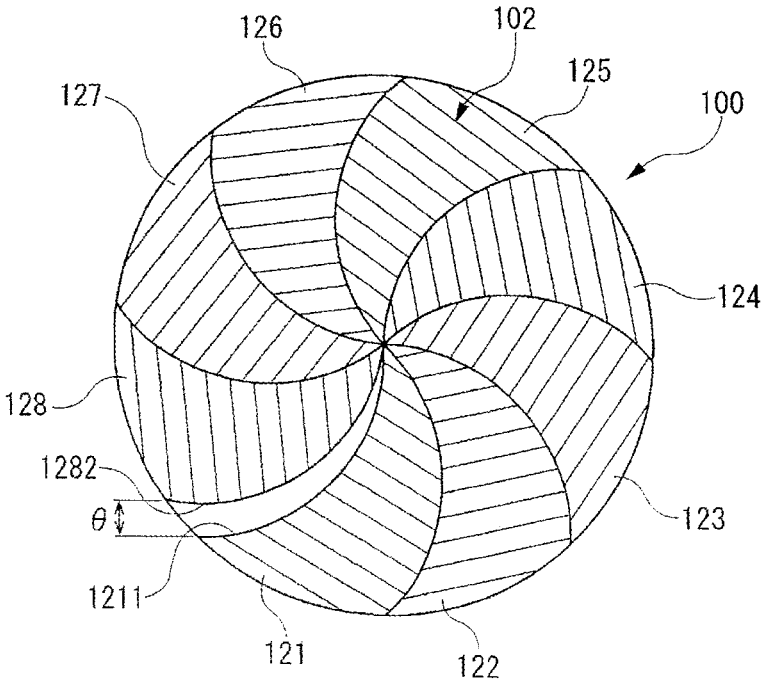
FIG. 4B is a plan view illustrating segment saw marks formed on the ground surface of the wafer when the rotational speed ratio is not an integer.

Meanwhile, when the rotational speed ratio RN is not an integer (RN=8.2, for example), in a period during which the chuck table 31 makes one rotation, RN (8) segment saw marks 121 to 128 including saw marks of substantially the same size are arranged on the ground surface 102 of the wafer 100, as illustrated in FIG. 4B. In this case, however, a displacement amount θ is provided between a starting position 1211 of the first segment saw mark 121 and an ending position 1282 of the last segment saw mark 128, and these positions are not coincident with each other.

Thus, displacement occurs in the starting position of the first segment saw mark 121 between the first rotation and the second rotation of the chuck table 31. Similarly, displacement occurs in the starting position of the first segment saw mark 121 between the second rotation and the third rotation of the chuck table 31, for example. It is to be noted that displacement occurs in the starting position of the first segment saw mark 121 also between the first rotation and the third rotation.

For this reason, the arrangement of the segment saw marks 121 to 128 on the ground surface 102 of the wafer 100 in the second rotation of the chuck table 31 is different from the arrangement of the segment saw marks 121 to 128 in the first rotation. Therefore, the grinding surface of the grindstone part 77 forms on the wafer 100 a locus different from that of the first rotation. Accordingly, displacement occurs between the height difference of the grinding surface of the grindstone part 77 and the irregularities already formed on the ground surface 102, and they interfere with each other, so that the protruding portions 131 can be ground off. In this manner, when the rotational speed ratio RN is not an integer, the saw marks 130 left after the spark-out processing are small compared to the case where the rotational speed ratio RN is an integer.

Based on the mechanism described above, the rotation controlling section 8 carries out the rotation control immediately after the spark-out processing is started, for example. In the rotation control, the rotation controlling section 8 first measures the thickness of the wafer 100 being ground, by using the noncontact thickness measuring instrument 60. The rotation controlling section 8 then detects the cyclic variations in thickness value (corresponding to the saw marks 130 described above) that appear along the direction of rotation of the wafer 100.

Further, the rotation controlling section 8 calculates a difference (hereinafter referred to as a maximum thicknesswise difference) between a minimum value and a maximum value of the cyclic variations in thickness value of the wafer 100. The maximum value indicates the height of the protruding portion 131 illustrated in FIG. 3A while the minimum value indicates the height of the recessed portion 132 illustrated in the same figure. The maximum thicknesswise difference indicates the height difference (height H1) between the protruding portion 131 and the recessed portion 132.

The rotation controlling section 8 then determines whether or not the maximum thicknesswise difference exceeds a tolerance. The tolerance is set, for example, using as a reference a desired thickness of the wafer 100 set in advance, that is, a target thickness value of the wafer 100 to be obtained after the grinding.

If the maximum thicknesswise difference (height H1) exceeds the tolerance, the rotational speed ratio RN described above is considered to substantially be an integer. In this case, the rotation controlling section 8 controls the table rotating mechanism 35 (see FIG. 1) to relatively change the rotational speed (150 rpm) of the chuck table 31 relative to the rotational speed (1650 rpm) of the spindle 72, for example, in a range from 145 to 155 rpm. The rotational speed ratio RN is thus no longer an integer.

Figure 3B:
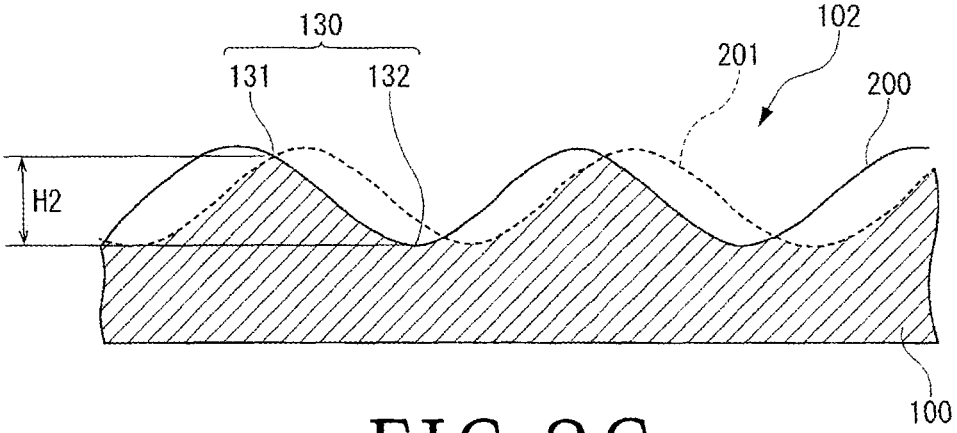

After such rotation control is carried out, the control unit 7 continues carrying out the spark-out processing while keeping the rotational speed of the chuck table 31 changed in the manner described above. In the spark-out processing, as illustrated in FIG. 3B, a first locus 201 (broken line), which is the locus of the grinding surface of the grindstone part 77 in the first rotation of the chuck table 31 after the change of the rotational speed, has shifted from the initial locus 200 (solid line), which is the locus obtained before the change of the rotational speed. The protruding portions 131 of the saw marks 130 having been formed so far are thus ground off by the grindstone part 77. As a result, the maximum thicknesswise difference (height H2) is smaller than the maximum thicknesswise difference (height H1).

Figure 3C:
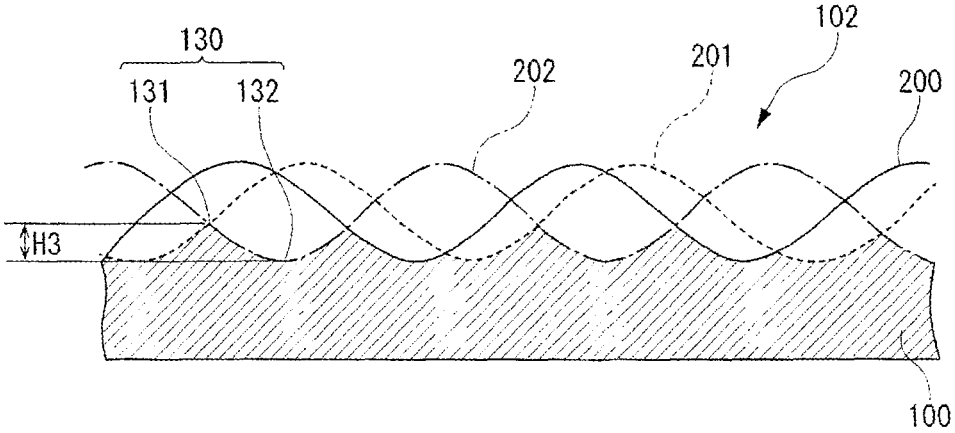

Further, as illustrated in FIG. 3C, a second locus 202 (alternate long and short dash line), which is the locus of the grinding surface of the grindstone part 77 in the second rotation of the chuck table 31 after the change of the rotational speed, is different from both the initial locus 200 (solid line) and the first locus 201 (broken line). The protruding portions 131 of the saw marks 130 are thus ground off further by the grindstone part 77. As a result, the maximum thicknesswise difference (height H3) is further smaller than the maximum thicknesswise difference (height H2). In this manner, the maximum thicknesswise difference can be made small through the spark-out processing in the present embodiment.

After the maximum thicknesswise difference falls within the tolerance, the control unit 7 determines that the ground surface 102 of the wafer 100 has been planarized, ends the spark-out processing, and carries out the escaping-cut processing described above (time range T6 of FIG. 2).

If the maximum thicknesswise difference does not fall within the tolerance even after a predetermined period of time elapses after the rotational speed of the chuck table 31 is changed, on the other hand, the control unit 7 stops the grinding processing operation. The control unit 7 then causes a display device (not illustrated) to make a display for the operator, as a processing error, indicating to the effect that the maximum thicknesswise difference does not fall within the tolerance.

As described above, in the present embodiment, the rotation controlling section 8 calculates the maximum thicknesswise difference in the wafer 100 by using the noncontact thickness measuring instrument 60 during spark-out processing, and if the maximum thicknesswise difference exceeds the tolerance, relatively changes the rotational speed of the chuck table 31 relative to the rotational speed of the spindle 72. By changing the rotational speed of the chuck table 31, even when the rotational speed ratio RN, which is a ratio between the rotational speed of the spindle 72 and the rotational speed of the chuck table 31, is an integer, the rotational speed ratio RN can be shifted from an integer. Therefore, the maximum thicknesswise difference formed on the ground surface 102 of the wafer 100 can be made small through the spark-out processing. As a result, the cyclic variations in thickness value of the wafer 100 are reduced, enabling planarization of the ground surface 102 of the wafer 100. Accordingly, it is possible to suppress formation of slight arcuate irregularities on the ground wafer 100.

It is to be noted that, preferably, initial settings are made for the rotational speed of the spindle 72 and the rotational speed of the chuck table 31 before the grinding processing is carried out in such a manner that the rotational speed ratio RN of them does not become an integer. However, even with such initial settings, a load or the like is applied on the grindstone part 77 and the chuck table 31, and therefore, the rotational speeds of the spindle 72 and the chuck table 31 can, in practice, be deviated from the initial settings. In such a case, the rotational speed ratio RN can become an integer. To avoid this, it is preferable that, even when the above initial settings are made, the rotation controlling section 8 carry out the rotation control as in the present embodiment to appropriately set the rotational speed of the chuck table 31 according to the measurement result of the thickness of the wafer 100 measured by the noncontact thickness measuring instrument 60.

Further, in the present embodiment, if the maximum thicknesswise difference exceeds the tolerance, the rotation controlling section 8 relatively changes the rotational speed (150 rpm) of the chuck table 31 relative to the rotational speed (1650 rpm) of the spindle 72, for example, in the range from 145 to 155 rpm. In this regard, it is preferable that the rotation controlling section 8 reduce the rotational speed of the chuck table 31 below the initial value (150 rpm) when the wafer 100 is rigid (SiC wafer, for example) while the rotation controlling section 8 increase the rotational speed of the chuck table 31 above the initial value (150 rpm) when the wafer 100 is a wafer easy to grind such as a silicon wafer.

In addition, in the present embodiment, the rotation controlling section 8 carries out the above-described rotation control for controlling the rotational speed of the chuck table 31 immediately after the spark-out processing is started, that is, in a period during which the lowering of the grindstone part 77 is stopped. It is to be noted that the rotation control may be carried out not immediately after the spark-out processing is started but at a timing immediately before the second grinding processing, which is carried out before the spark-out processing is started, is ended. Alternatively, the rotation controlling section 8 may carry out the control of the rotational speed over a period from the second grinding processing to the spark-out processing. That is, the rotation controlling section 8 may carry out part of the rotation control operation (operation up to determination as to whether or not the maximum thicknesswise difference exceeds the tolerance, for example) immediately before the second grinding processing is ended, and may carry out rest of the rotation control operation immediately after the spark-out processing is started. Further alternatively, the rotation controlling section 8 may carry out the rotation control after a predetermined period of time has elapsed after the spark-out processing is started. It is to be noted that the rotation controlling section 8 may control the rotational speed of the spindle 72 instead of controlling the rotational speed of the chuck table 31.

The present invention is not limited to the details of the above described preferred embodiment. The scope of the invention is defined by the appended claims and all changes and modifications as fall within the equivalence of the scope of the claims are therefore to be embraced by the invention.

What is claimed is:

1. A grinding apparatus comprising:

a chuck table having a holding surface to hold a wafer thereon, wherein an axis of rotation of the chuck table extends through a center of the holding surface;

a grinding unit that is mounted to a distal end of a spindle and that grinds the wafer by using a plurality of grindstones arranged in an annular fashion, the grindstones being rotated in such a manner as to pass above the center of the holding surface;

a spindle rotating mechanism configured to rotate the spindle;

a noncontact thickness measuring instrument configured to measure a thickness of the wafer held on the holding surface, in a noncontact manner; and a rotation controlling section that causes the chuck table to rotate and that carries out rotation control by:

measuring the thickness of the wafer being ground with the noncontact thickness measuring instrument, calculating a difference between a minimum value and a maximum value of cyclic variations in a thickness value of the wafer, wherein the variations are generated along a direction of rotation of the wafer, and changing a rotational speed of the chuck table in a relative manner with respect to a rotational speed of the spindle when the difference between the minimum value and the maximum value of the cyclic variations in the thickness value of the wafer exceeds a tolerance based on a desired thickness set in advance.

2. The grinding apparatus according to claim 1, wherein the rotation controlling section carries out the rotation control in a period during which movement of the grindstones in a direction approaching the holding surface is stopped.

3. A grinding apparatus comprising:

a chuck table having a holding surface to hold a wafer thereon, wherein an axis of rotation of the chuck table extends through a center of the holding surface;

a grinding unit that is mounted to a distal end of a spindle and that grinds the wafer by using a plurality of grindstones arranged in an annular fashion, the grindstones being rotated in such a manner as to pass above the center of the holding surface;

a spindle rotating mechanism configured to rotate the spindle;

a noncontact thickness measuring instrument configured to measure a thickness of the wafer held on the holding surface, in a noncontact manner; and a rotation controlling section that causes the chuck table to rotate and that carries out rotation control by:

measuring the thickness of the wafer being ground with the noncontact thickness measuring instrument, calculating a difference between a minimum value and a maximum value of cyclic variations in a thickness value of the wafer, wherein the variations are generated along a direction of rotation of the wafer, and changing a rotational speed of the chuck table in a relative manner with respect to a rotational speed of the spindle based on the calculated difference between the minimum value and the maximum value of the cyclic variations in the thickness value of the wafer.

4. The grinding apparatus according to claim 3, wherein the rotation controlling section carries out the rotation control in a period during which movement of the grindstones in a direction approaching the holding surface is stopped.

* * * * *